US005845373A

United States Patent [19]

Langer

[11] Patent Number: 5,845,373

[45] Date of Patent: Dec. 8, 1998

[54] JEWELRY LATCH

[76] Inventor: Erich Langer, Steyrer Strasse 13, A-4470 Enns, Austria, A-4470

[21] Appl. No.: 916,473

[22] Filed: Aug. 22, 1997

[30] Foreign Application Priority Data

Aug. 23, 1996 [AT] Austria ..... 490/96

[51] Int. Cl.[6] ..... A44B 21/00; A44C 5/00

[52] U.S. Cl. ..... 24/303; 24/3.6; 24/71 J

[58] Field of Search ..... 24/303, 66.1, 71 J, 24/265 WS, 3.6; 292/251.5; 70/459; 248/206.5; 335/285

[56] References Cited

U.S. PATENT DOCUMENTS

| | | | |
|---|---|---|---|
| 2,975,497 | 3/1961 | Budreck | 24/303 |
| 3,111,736 | 11/1963 | Budreck | 24/303 |
| 3,129,477 | 4/1964 | Mizuno | 24/303 |
| 3,192,747 | 7/1965 | Stupell et al. | 24/303 |
| 3,277,681 | 10/1966 | Bey | 24/303 |
| 4,231,137 | 11/1980 | Fujimoto | 24/303 |
| 5,367,891 | 11/1994 | Furuyama | 24/303 |
| 5,477,714 | 12/1995 | Bishop | 24/3.6 |
| 5,572,887 | 11/1996 | Geswelli | 24/303 |

FOREIGN PATENT DOCUMENTS

| | | | |
|---|---|---|---|
| 2855708 | 7/1979 | Germany | 24/303 |

*Primary Examiner*—Victor N. Sakran
*Attorney, Agent, or Firm*—Collard & Roe, P.C.

[57] ABSTRACT

A latch for an article of jewelry, which comprises two magnetically attractable latch members, each latch member comprising a hollow body defining a cavity and open on one side, the hollow body having a circumferentially extending edge at the open side, a magnetic insert contained in the cavity, and a closure platelet covering the open side of the hollow body, the platelet being friction-fitted in the edge.

3 Claims, 1 Drawing Sheet

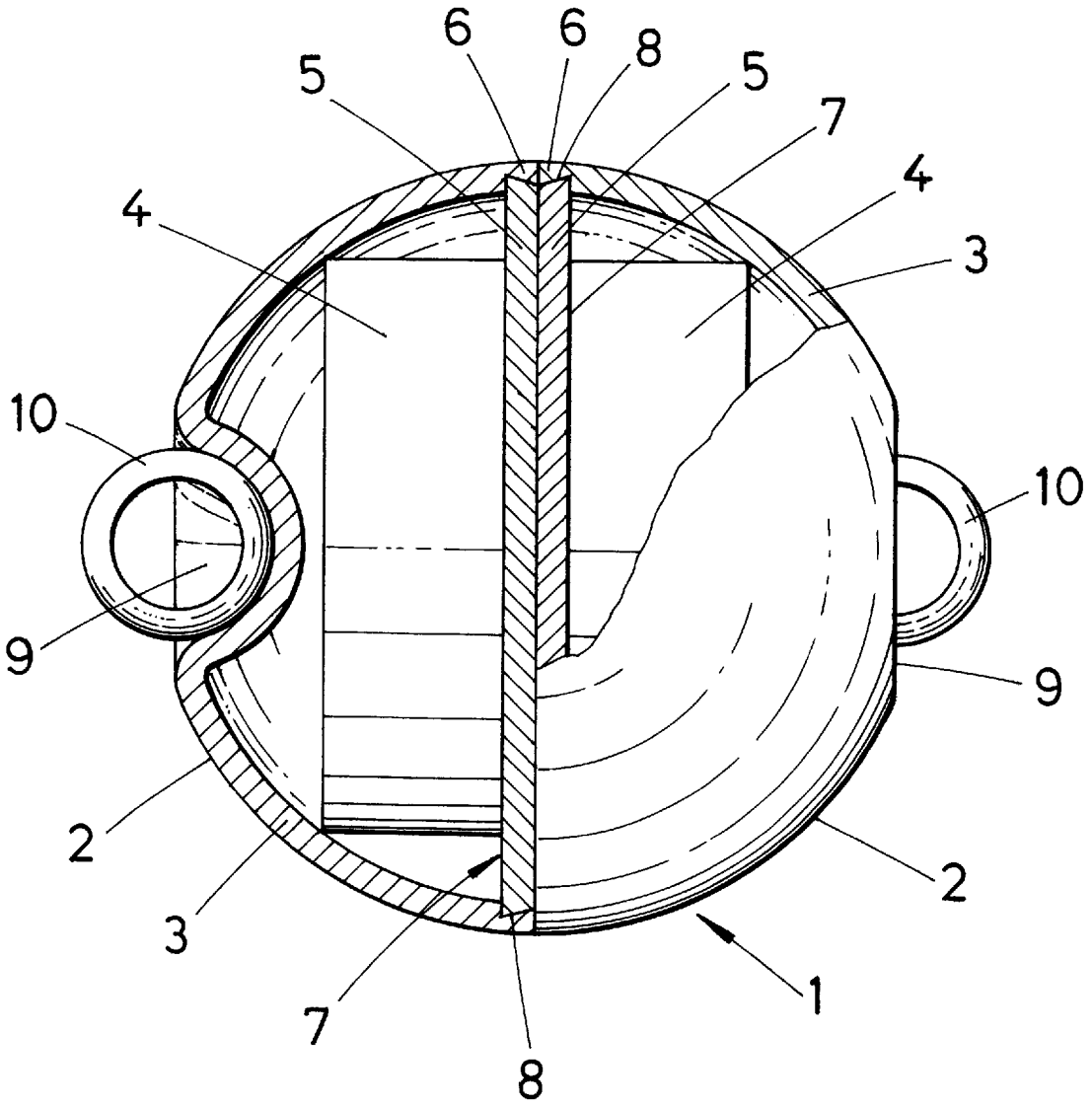
6
6
8
5
5
7
4
4
3
10
10
9
9
2
2
3
7
8
1

JEWELRY LATCH

BACKGROUND OF THE INVENTION

1. Field of the Invention

The present invention relates to a latch for an article of jewelry, which comprises two magnetically attractable latch members, each latch member comprising a hollow body defining a cavity and open on one side, and a magnetic insert contained in the cavity.

2. Description of the Prior Art

Conventional latches for articles of jewelry mostly comprise two members which may be mechanically connected to each other, which requires a certain manual dexterity, which are not easy to manufacture, and may become detached from each other under an overload because they are only hooked together.

It is also known to provide latches for articles of jewelry, which comprise two magnetically attractable members to obtain a latch which is easily handled, simple to produce and is secure against opening when subjected to a load. In these known magnetic latches, the magnetic inserts are bonded to the hollow body containing them. The open sides of the hollow bodies face each other when the latch is closed, and ambient influences, such as humidity, skin excretions and the like may penetrate into the cavities housing the magnetic inserts. This causes the magnetic inserts, which often consist of sintered bodies, to corrode and, within a relatively short time, the bond between the magnetic insert and the hollow body may deteriorate and the latch malfunctions. In addition, the remaining spaces between the hollow body and the magnetic insert constitute unhygienic repositories for dirt, which are very difficult to clean. Also, the marginal gap between the hollow body and magnetic insert leads to unevenness in the closure plane, which may interfere with the relative lateral displacement of the two members to open the latch. Finally, surface of the hollow bodies with their magnetic inserts cannot be subjected to a finishing treatment by galvanizing or the like because the magnetic inserts are not protected, on the one hand, and the coating bath may be contaminated by the magnetic inserts.

SUMMARY OF THE INVENTION

It is the primary object of this invention to overcome the above-mentioned disadvantages and to provide a magnetic latch of the first-indicated type that can be very rationally manufactured, provides a secure closure, has a long operating life and is hygienically acceptable.

The above and other objects are accomplished according to the invention with a latch for an article of jewelry, which comprises two magnetically attractable latch members each latch member comprising a hollow body defining a cavity and open on one side, the hollow body having a circumferentially extending edge at the open side, a magnetic insert contained in the cavity, and a closure platelet covering the open side of the hollow body, the platelet being friction-fitted in the edge.

In this simple way, the cavity in the hollow body is closed off and the magnetic insert is fully protected from ambient influences while being securely and permanently held in the cavity without any adhesive or other fastening means. The closure platelet itself forms the closure plane, and its form-fitting engagement in the edge of the hollow body assures a smooth surface along the closure plane without any dirt-collecting edges and gaps. In addition, the closure platelet may serve as the carrier for the magnetic insert. At the same time, the latch has all the advantages of magnetically, rather than mechanically, closed latches. The magnetic inserts in the two latch members cause the latch members to be automatically centered when closed, and the latch may be readily opened simply by sliding the two latch members relative to each other along the closure plane formed by the two closure platelets extending parallel to each other. Furthermore, the shape and configuration of the hollow bodies may be selected independently of the magnetic inserts.

According to one preferred feature of the present invention, the edge circularly surrounds the open side and the closure platelet has an outwardly converging frusto-conical circumference mating with a conforming circumferential groove in the edge. When the closure platelet is pressed into the conforming groove of the edge, the cavity in the hollow body is effectively sealed and the magnetic insert is fully protected from any outside influences. Furthermore, these sealed hollow bodies containing the magnetic inserts may be suitably surface-treated since the treatment bath will not contact the sealed-off magnetic inserts, thus having no corrosive influence on them nor being contaminated by them. The sealed latch members and the possibility of a suitable surface treatment thereof assures that the latch will meet all hygienic requirements.

The functionality and aesthetics of the match will be optimized with a hollow body which is substantially hemispherical and a magnetic insert which is cylindrical.

The hollow body with its magnetic insert may be attached as a latch member to all sorts of jewelry articles by any suitable fastening means, such as soldering, bonding, clamping, hooking and the like. In an embodiment particularly useful for attachment to jewelry chains, such as necklaces and bracelets, the hollow body defines an indentation opposite the open side covered by the closure platelet, the indentation receiving an eyelet. The indentation forms a receptacle partially surrounding the eyelet to provide a secure and aesthetically acceptable attachment to the end of the jewelry chain. At the same time, the indentation projecting into the cavity of the hollow body may also serve as a support for the magnetic insert inside the cavity.

BRIEF DESCRIPTION OF THE DRAWING

The above and other objects, advantages and features of this invention will become more apparent from the following detailed description of a now preferred embodiment, taken in conjunction with the single FIGURE of the drawing schematically snowing a side view of a latch, partially in section.

DETAILED DESCRIPTION OF THE PREFERRED EMBODIMENT

As shown in the drawing, latch 1 for an article of jewelry (not shown) comprises two magnetically attractable latch members 2. Each latch member comprises hollow body 3 defining a cavity and open on one side. The hollow body has a circumferentially extending edge 6 at open side 7, and magnetic insert 4 is contained In the cavity. A closure platelet 5 covers the open side of hollow body 3, the platelet being friction-fitted in edge 6.

In the illustrated embodiment, edge 6 circularly surrounds open side 7 and closure platelet 5 has an outwardly converging frusto-conical circumference 8 mating with a conforming circumferential groove in edge 6. The illustrated hollow body is substantially hemispherical and the magnetic insert is cylindrical.

As shown, hollow body 3 defines indentation 9 opposite open side 7 covered by closure platelet 5, the indentation receiving an eyelet 10, which may be soldered to the hollow body for attachment of a chain or the like.

What is claimed is:

1. A latch for an article of jewelry, which comprises two magnetically attractable latch members, each latch member comprising (a) a hollow body defining a cavity and open on one side, the hollow body having (1) a circumferentially extending edge at the open side, (b) a magnetic insert contained in the cavity, and (c) a closure platelet covering the open side of the hollow body, the platelet being friction-fitted in the edge, (d) the edge circularly surrounding the open side and the closure platelet having an outwardly converging frustoconical circumference mating with a conforming circumferential groove in the edge.

2. The latch of claim 1, wherein the hollow body is substantially hemispherical and the magnetic insert is cylindrical.

3. The latch of claim 1, wherein the hollow body defines an indentation opposite the open side covered by the closure platelet, the indentation receiving an eyelet.

* * * * *